United States Patent [19]

Barres

[11] 4,070,828

[45] Jan. 31, 1978

[54] DEVICE AND METHOD FOR RECYCLING HYDROCARBON VAPORS OF I.C.E. VEHICLES

[75] Inventor: Roland Barres, Boulogne-Billancourt, France

[73] Assignees: Regie Nationale des Usines Renault, Boulogne-Billancourt; Automobiles Peugeot, Paris, both of France

[21] Appl. No.: 649,081

[22] Filed: Jan. 14, 1976

[30] Foreign Application Priority Data

Jan. 15, 1975 France ..... 75 01130

[51] Int. Cl.[2] ..... F01N 3/10

[52] U.S. Cl. ..... 60/274; 60/307; 123/136

[58] Field of Search ..... 60/307, 283, 274; 123/136

[56] References Cited

U.S. PATENT DOCUMENTS

| | | | |
|---|---|---|---|
| 3,001,519 | 9/1961 | Dietrich | 123/136 |
| 3,191,587 | 6/1965 | Hall | 123/136 |
| 3,618,314 | 11/1971 | Krebs | 60/283 |
| 3,645,098 | 2/1972 | Templin | 60/288 |
| 3,680,318 | 8/1972 | Nakajima | 123/136 |
| 3,913,545 | 10/1975 | Haase | 123/136 |

*Primary Examiner*—Douglas Hart
*Attorney, Agent, or Firm*—Fleit & Jacobson

[57] ABSTRACT

The invention is directed to a novel method and means for recycling to the carburetor the hydrocarbon vapors emitted by a motor vehicle of the type comprising between the fuel tank and the pipe connecting the air filter to the carburetor a container or canister for adsorbing the hydrocarbons. In the method of this invention, the hydrocarbons thus adsorbed by a suitable material contained in the canister are desorbed by using a stream of air under pressure from a pump, for example the anti-pollution pump provided for injecting fresh atmospheric air into the exhaust system of the vehicle.

3 Claims, 4 Drawing Figures

DEVICE AND METHOD FOR RECYCLING HYDROCARBON VAPORS OF I.C.E. VEHICLES

This invention relates in general to methods of and means for controlling the emission of hydrocarbon gases or vapours from automotive vehicles and more particularly from the fuel tanks thereof.

In fact, it is known that temperature fluctuations entail an expansion and a concentration of the gases overlying the liquid level in the fuel tanks of motor vehicles. This is likely to drive hydrocarbon gases or vapours out from the tank, especially when the surrounding temperature is relatively high and the hydrocarbon vapour gas tension is relatively high.

In order to reduce considerably this source of atmospheric pollution, it has already been proposed to interpose along the path followed by the gases thus emitted from the fuel tank a chamber usually referred to as a "canister" which is filled with activated carbon adapted to fix the hydrocarbons which are subsequently purified and re-injected into the induction system of the engine through various devices.

For obvious reasons, it is advantageous to recover the hydrocarbons thus deposited and to regenerate the activated carbon with the best possible degree of efficiency. With this end in view, the higher the air stream output directed through the mass of activated carbon, the higher the efficiency of the recovery process.

It is the specific object of the present invention to provide a method for the purpose set forth hereinabove which comprises the step of utilizing an existing source of high-output incident air already used for other purposes. Furthermore, this invention is directed to provide a device for carrying out this method.

The present invention relates more particularly to a method of recycling the hydrocarbon vapours emitted by a motor vehicle of the type comprising, between the fuel tank and the pipe connecting the air filter to the carburetor, a hydrocarbon adsorption container or canister, characterised in that the hydrocarbons adsorbed in said canister are desorbed or expulsed by means of an air stream under pressure delivered by a pump, for example the anti-pollution pump adapted to inject fresh air into the exhaust system of the vehicle.

In the device for carrying out the above-disclosed method the canister is connected directly to a compressed air outlet, preferably the outlet of an anti-pollution pump.

This invention is also concerned with a canister of the type broadly set forth hereinabove, which is characterized in that a partition or baffle is provided in said canister and extends at right angles to and from the canister wall in which the air inlet port and the hydrocarbon gas outlet port are formed, said partition or baffle being disposed substantially at the same distance from said ports, said canister wall being opposite the canister cover, the arrangement being such that said partition or baffle is substantially coplanar with the longitudinal axis of said canister and has a length so calculated that it will not interfere with the free gas flow while elongating the path followed by said gas flow within the canister to ensure a maximum utilization or efficiency of the adsorption material contained therein.

In a preferred form of embodiment of this canister the cover in which the purifying air delivery port is formed comprises a peripheral gasket providing the necessary tightness to hydrocarbon vapours.

This invention will now be described more in detail with reference to the attached drawings, in which.

Figures 1, 2:
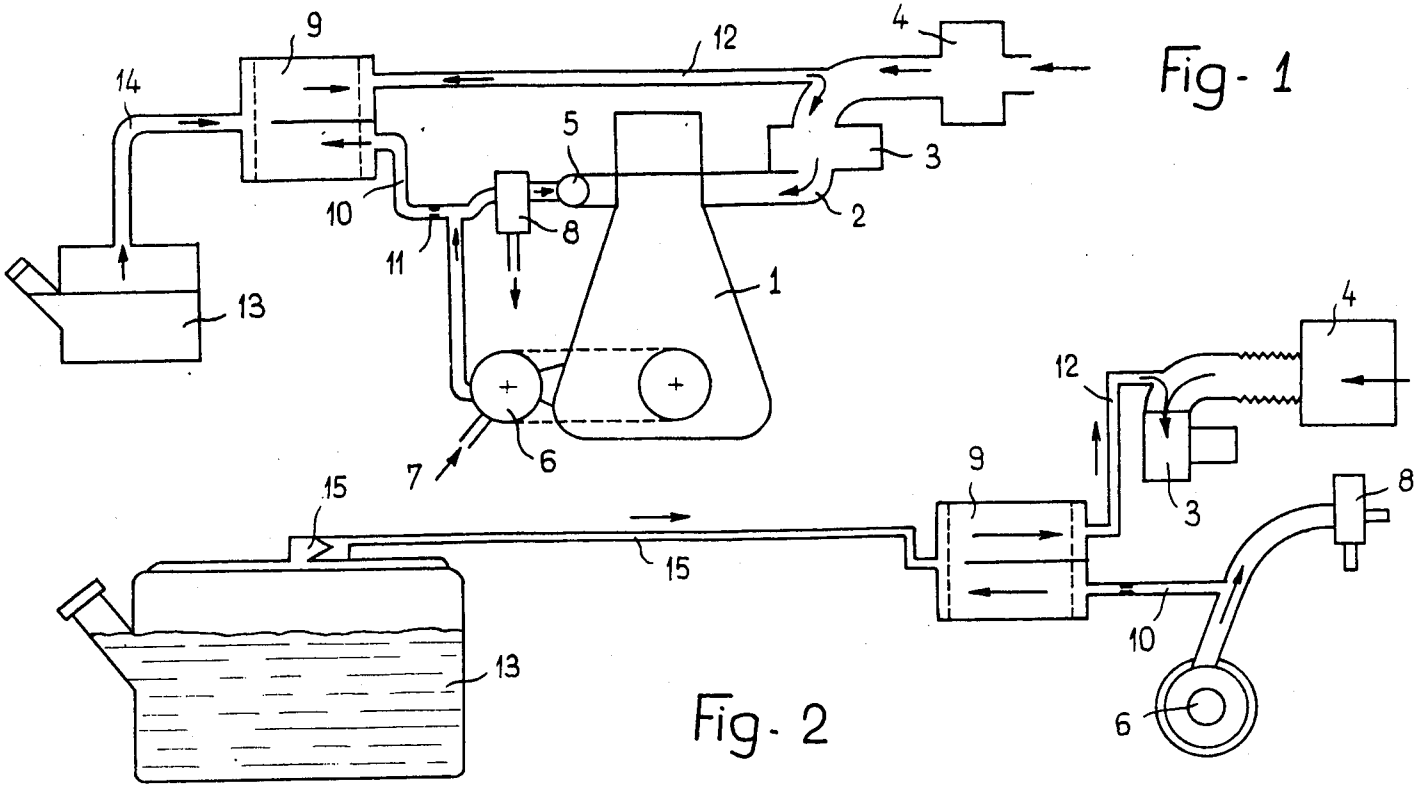
FIG. 1 is a diagrammatic illustration of a typical and preferred form of embodiment of the gaseous hydrocarbon recycling device according to this invention.
FIG. 2 is a detailed view of the device of FIG. 1.

Referring first to FIG. 1, it will be seen that an engine 1 is equipped on its right hand side with an induction manifold 2, a carburetor 3 and an air filter 4, and on its left-hand side, with an exhaust system 5 and a so-called "manairox" device comprising a pump 6 drawing atmospheric air from an intake 7 and delivering it under pressure into the exhaust system under predetermined conditions via a diverter 8 or like distributor adapted, in other circumstances, to release this air to the atmosphere. This arrangement is already known per se and is based on now conventional methods of producing the post-combustion of unburnt hydrocarbons by injecting air into the exhaust system.

The fuel tank 13 is connected to a canister 9 comprising on the one hand an air inlet 10 incorporating in turn a jet 11 and connected to the "manairox" circuit, and on the other hand an outlet 12 directed to the carburetor 3. Inserted in the conduit 14 connecting the tank 13 to the canister 9 is a non-return valve 15 (see FIG. 2).

Figure 3:
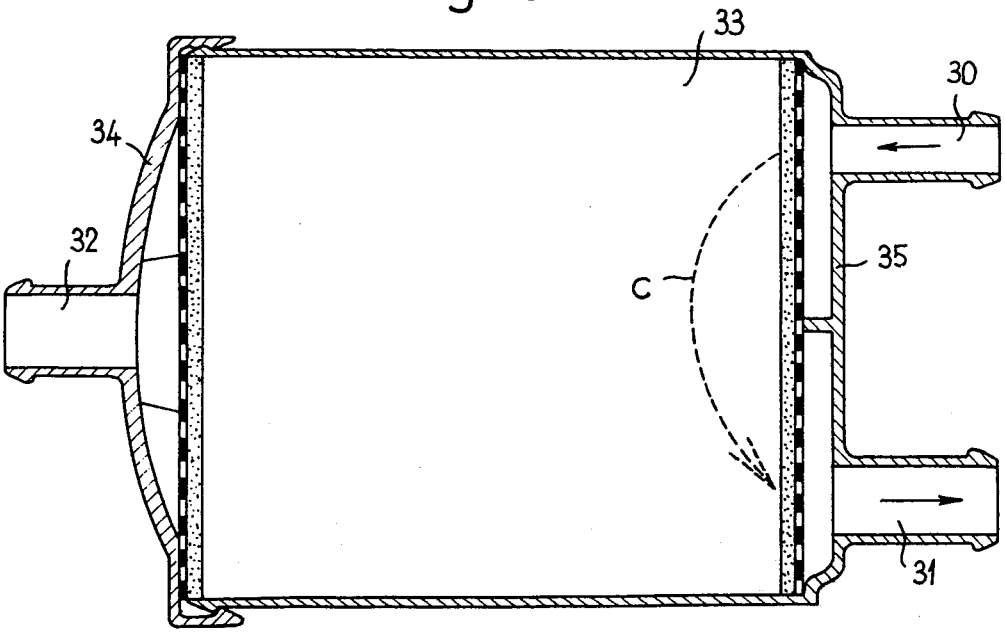
FIG. 3 is an axial section taken along a canister according to the prior art.

The conventional canister (see FIG. 3) comprises on a same wall 35 opposite the cover 34 an inlet port 30 for the hydrocarbon gases from the fuel tank 13 and an outlet port 31 for said gases, the purifying air being delivered to the canister via a conduit 32 extending through the cover 34.

In actual practice, it was observed that with this conventional canister the gases received from the fuel tank could not be retained completely since a by-pass or short circuit was created between the ducts 30 and 31, and prevented a complete utilization of the entire adsorption mass 33 consisting for example of carbon black or activated carbon.

Figure 4:
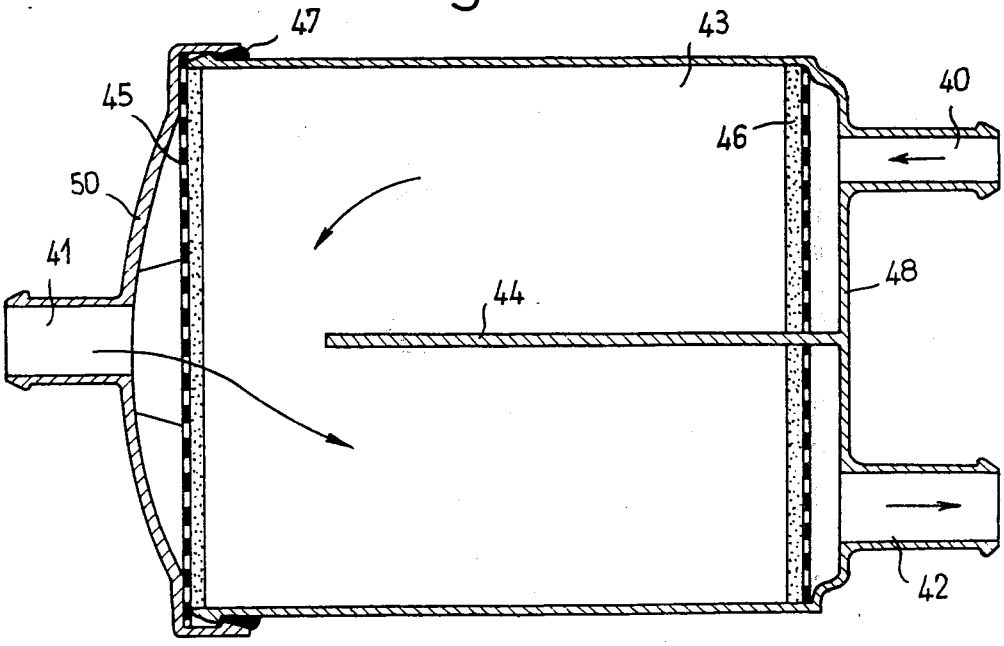
FIG. 4 is a view similar to FIG. 3, but showing a canister according to the present invention.

To avoid this inconvenience the canister according to the present invention, which is illustrated in FIG. 4 of the drawings, comprises an inlet port 41 for the incident gases loaded with hydrocarbon vapours, which extends through the cover 50, and an outlet port 42 together with an inlet port 40 for the atmospheric air from the "manairox" device, these last-mentioned ports 40, 42 extending through the canister end wall opposite said cover. The adsorbing material 43 is of the same type as that utilized in conventional canisters but divided in this case by a transverse partition or baffle 44 extending at right angles, and secured, to the wall 48, and adapted to prevent any by-pass effect between said ports 40 and 42. However, this partition or baffle 44 leaves a passage of a width corresponding to about one-fifth of the distance measured between the porous cover and the opposite wall 45, 46 of the canister filled with the adsorbing material 43. A peripheral gasket 47 is provided to prevent any leakage of hydrocarbons between the canister body and its cover.

The operation of the above-described system according to this invention involves two phases:

1. The adsorption of hydrocarbon vapours from the fuel tank (the latter being fluid-tight) under all circumstances involving a increment in the fuel temperature. In this case, the thus loaded gas penetrates through the port 41 into the canister (FIG. 4). The hydrocarbons are thus fixed to the entire mass of material 43 and adsorbed thereby while the purified air escapes through the outlet port 42 towards the engine air filter.

2. The desorption of the hydrocarbons. This step takes place during the engine operation, i.e. when the engine drives through any known and suitable means the pump 6. The atmospheric air introduced into the "manairox" circuit at 7 flows into the canister via port 40 (FIG. 4) and through the adsorption material 43 until it is ejected via port 42 towards the carburetor.

The air compressed by pump 6 is heated, thus facilitating the desorption of hydrocarbons in the mass of material 43. Of course, due consideration is taken of this enriched mixture when setting the carburetor, the latter thus recovering the fuel that otherwise would have been diffused through the surrounding atmosphere and cause the pollution thereof.

However, it will be noted that during this purifying step fresh air is still directed through the entire mass of material 43 but with an output greater than the output usually obtained up to now, without resorting to any additional means since the pump 6 was already contemplated in prior art arrangements.

Of course, this invention should not be construed as being strictly limited by the specific form of embodiment disclosed hereinabove with reference to the attached drawings, since it includes all modifications and changes brought to a system of this character utilizing a canister equipped with an internal partition or baffle.

What is claimed as new is:

1. A method for use with an engine having a carburetor, an air filter, a pipe connecting the carburetor and air filter, an exhaust system, a fuel tank and employing an anti-pollution pump for injecting fresh air into the exhaust system of the engine, the method for supplying to the carburetor the hydrocarbon vapours emitted by the engine comprising the steps of, providing a hydrocarbon adsorption canister between the fuel tank and the pipe connecting the air filter and the carburetor, wherein the hydrocarbons are adsorbed by the material contained in said canister, supplying an air stream under pressure produced by said pump to said canister, whereby the hydrocarbon vapours are desorbed by means of the air stream, and supplying the desorbed hydrocarbon vapours in the air stream to the carburetor.

2. Apparatus for use with an engine having a carburetor, an air filter, a pipe connecting the carburetor and air filter, an exhaust system, a fuel tank and equipped with an anti-pollution pump for injecting fresh atmospheric air into the exhaust system of the engine for supplying to the carburetor the hydrocarbon vapours emitted by the engine comprising, an adsorption canister having a hydrocarbon inlet port connected to the fuel tank and a hydrocarbon outlet port connected to the pipe connecting the air filter to the carburetor and a compressed-air inlet port connected to the delivery port of said pump, and having a partition of preselected length arranged substantially along the longitudinal axis of said canister and extending within said canister from an end wall thereof said end wall having disposed therethrough said compressed air inlet port and said hydrocarbon outlet port with said partition disposed substantially therebetween, whereby said hydrocarbons adsorbed by the material in said canister are desorbed by the compressed-air stream and fed to the carburetor.

3. The apparatus of claim 2 wherein said preselected length of said partition is sufficient to avoid any interference with said hydrocarbon inlet port while permitting substantial elongation of the path from said compressed-air inlet port to said hydrocarbon outlet port.

* * * * *